United States Patent [19]

Emilio

[11] Patent Number: 5,033,934

[45] Date of Patent: Jul. 23, 1991

[54] FORK UNIT FOR LIFT TRUCKS

[75] Inventor: Bolzoni Emilio, Placenza, Italy

[73] Assignee: Costruzioni Meccaniche Bolzoni S.p.A., Piacenza, Italy

[21] Appl. No.: 593,261

[22] Filed: Oct. 1, 1990

Related U.S. Application Data

[63] Continuation of Ser. No. 504,682, Apr. 4, 1990, abandoned, which is a continuation of Ser. No. 430,938, Nov. 2, 1989, abandoned, which is a continuation of Ser. No. 252,319, Sep. 30, 1988, abandoned.

[30] Foreign Application Priority Data

Oct. 28, 1987 [IT] Italy ..... 22436 A/87

[51] Int. Cl.[5] ..... B66F 9/14

[52] U.S. Cl. ..... 414/667; 414/671

[58] Field of Search ..... 414/663, 664, 667, 668, 414/670, 671

[56] References Cited

U.S. PATENT DOCUMENTS

| | | | |
|---|---|---|---|
| 2,270,664 | 1/1942 | Weaver | 414/667 |
| 2,709,018 | 5/1955 | Schenkelberger | 414/667 |
| 3,460,700 | 8/1969 | Kroupa | 414/667 |
| 3,734,327 | 5/1973 | Ellis, Jr. | 414/667 |
| 3,780,896 | 12/1973 | Crawford | 414/667 |
| 3,819,078 | 6/1974 | Walsh | 414/671 |
| 4,165,008 | 8/1979 | Faust et al. | 414/667 X |
| 4,173,425 | 11/1979 | Dixon et al. | 414/667 |
| 4,406,557 | 9/1983 | Gaibler | 414/667 |
| 4,607,997 | 8/1986 | Asano | 414/667 |

FOREIGN PATENT DOCUMENTS

| | | | |
|---|---|---|---|
| 226891 | 6/1968 | Austria | 414/667 |
| 629809 | 7/1963 | Belgium | 414/667 |
| 759310 | 5/1967 | Canada | 414/667 |
| 199544 | 10/1986 | European Pat. Off. | 414/667 |
| 2336597 | 1/1975 | Fed. Rep. of Germany | 414/667 |
| 2716659 | 10/1978 | Fed. Rep. of Germany | 414/671 |
| 2716704 | 10/1978 | Fed. Rep. of Germany | 414/667 |
| 3515524 | 11/1986 | Fed. Rep. of Germany | 414/667 |
| 2306931 | 12/1976 | France | 414/667 |
| 2099787 | 12/1982 | France | 414/664 |
| 33245 | 3/1977 | Japan | 414/671 |
| 8201527 | 11/1983 | Netherlands | 414/667 |
| 930077 | 7/1963 | United Kingdom | 414/667 |
| 964161 | 7/1964 | United Kingdom | 414/667 |

*Primary Examiner*—Robert J. Spar
*Assistant Examiner*—Robert S. Katz
*Attorney, Agent, or Firm*—Finnegan, Henderson, Farabow, Garrett & Dunner

[57] ABSTRACT

A fork unit mountable on the fixed front plate member of a lift truck comprises a movable frame to which the forks of the fork unit are restrained by respective shanks lying in the same plane that contains the frame. Between the upper and lower edges of the plate and the frame, provision is made for reciprocal coupling and a guide, and a hydraulic cylinder for translating the frame with respect to the plate acts between the plates and frame. The concept of side-shift device with fork-bearing is thus eliminated and this brings the advantage of a minimal overhang of the load moved by the lift truck.

3 Claims, 3 Drawing Sheets

10
11A
11B
12
13
14
15
16
17
18
19
20
21
22
23
24
2
F

FORK UNIT FOR LIFT TRUCKS

This application is a continuation of application Ser. No. 07/504,682 filed April 4, 1990 (now abandoned) which is a continuation of application Ser. No. 07/430,938 filed Nov. 2, 1989 (now abandoned) which is a continuation of application Ser. No. 07/252,319 filed Sept. 30, 1988 (now abandoned).

BACKGROUND OF THE INVENTION

The present invention relates to a fork unit that can be applied to the fixed front plate member of a lift truck and which can be side-shifted with respect to the said plate and the position of the forks of which can be adjusted with respect to a bearing frame.

There are well known to persons with ordinary skill in the art lift trucks in which the forks or equivalent gripping means are mounted on a fixed front support plate of the truck as a result of the interposition of a device that permits the forks to be shifted sideways. Such a device is commonly known in the art as a side-shift device, and it allows the forks to be shifted so that the taking-up and depositing of the load can be done correctly, even with the lift truck only in approximate alignment with the load.

However, the adoption of a side-shift device on a fork lift truck-entails an unwanted increase in load overhang equal to the thickness of such device, and accordingly increases the overturning moment of the lift truck itself.

For this reason, for a side-shift device to be advantageously mounted on a fork lift truck, its essential prerequisite is low thickness—in any case a thickness reduced to the indispensable minimum. A fork side-shift device embodied according to the conventional art comprises a guide which is coupled to the truck plate member (with lifting movement) and on which the side-shift device plate (with lateral movement) slides. The distance between the former plate and the latter plate, here expressed as side-shift device thickness, results in an identical increase in fork overhang with respect to the barycentre of the lift truck and thus to a decrease in lift capacity over and above the decrease necessarily caused by the weight of the device per se. Given the foregoing, it will be seen how much importance attaches to providing a construction that will appreciably reduce load overhang.

In the known art, two factors most affect the total side-shift device thickness: the first of these is the thickness of the side-shift device plate and its guides, and the second is the overall bulk of the hydraulic cylinder which, acting between the front plate of the lift truck and the fork side-shift device, controls the side-shift of the latter with respect to the fixed plate.

The hydraulic cylinder must in fact be able to develop a thrust adequate to the load to be moved carried by the lift truck and to the passive resistances due to the friction between the sliding-contact guides between the fixed and movable plates. Moreover, being fed by fluid at the pressures usual in oleodynamic circuit applied to this type of device, the cylinder must be of adequate section.

Manufacturers of lift trucks and relative equipment have long put forward different solutions for achieving an ideal fork side-shift device, i.e. one which keeps weight and thickness and loss of operator load viewability to a minimum. There have been proposed for this purpose fork side-shift devices having rolling guides, which without doubt lower the power required and thus the dimensions of the hydraulic cylinder; but, at the same time, this involves a very significant complexity of the structural elements of the fork side-shift device.

Entirely ball-packed guides have also been proposed German patent 2317758), but again with unsatisfactory results due to deformations of the ball bearing races in the terminal areas of the guides, which cause jamming.

Lastly, guides with inserted shoes, fixed with screws, made of hardened material, have been proposed, but with negative results owing to increases in thickness and costs.

As is evident from the foregoing, every effort has been made to reduce the aforesaid passive resistances so as to be able to decrease the thrust required of the hydraulic operating cylinder, and thus also its diameter, and consequently to reduce the total thickness of the fork side-shift device. A rational disposition and configuration of parts, as illustrated in Italian model application 22923 B/78, makes it possible to have a side-shift device with a total thickness only slightly greater than the side-shift plate itself, such slightly greater thickness being due to the bulk of the members for coupling to the lift truck plate and to the slide surfaces. This solution appears to attain the minimum possible thickness for the purpose of embodying a fork side-shift device to be coupled to the fixed plate of a lift truck.

To further reduce bulk, it has been proposed to eliminate the usual vertical-shift-only fork-bearing plate featured in all lift trucks by placing the fork side-shift device between the slide running in the truck masts and the plate so that this last can shift horizontally and vertically. However, this solution calls for a modification of the structure of the lift truck itself which has to be equipped with the side-shift device already during its construction, and so the said device loses its nature of an additional element to be applied to the standardized plate of a lift truck, if and when necessary, for the handling of certain loads with the use of forks.

The overall object of the present invention, on the other hand, is to solve the problems of the know art in a satisfactory manner by wholly abandoning the traditional structure of a fork side-shift device consisting of a movable fork-bearing plate than can be slidingly coupled to the truck plate with a hydraulic operating cylinder between the two.

The present invention, instead, proposes an operating unit in which the forks are integrated with a side-shift device.

SUMMARY OF THE INVENTION

According to the invention the aforesaid object is attained by emboding a fork unit that can be mounted on the front plate member of a lift truck, wherein there are comprised, in combination: a movable frame to which the forks are restrained by respective shanks which lie substantially in the same plane as contains the said frame, provision being made between the upper and lower edges of the said plate member and frame for reciprocal coupling and guide means, a hydraulic cylinder acting between the said plate and frame to side-shift the frame with respect to the plate member.

Proximal to the upper edges of the fixed plate member and movable frame, the said reciprocal coupling and guide means can advantageously consist of a pair of telescopic elements fixed respectively to the upper edge of the plate member and to the upper edge of the frame, the inner telescopic element also comprising the said hydraulic operating cylinder.

On the other hand, proximal to the lower edges of the fixed plate member and the movable frame the reciprocal coupling means and guide means can consist of ledge-type coupling. Preferably, the forks are mounted on the frame in a sideways adjustable manner.

To such end each fork can be translated at the base of its shanks along a shafting of the frame, while provision is made at the top of the shank for a disengageable claw-tooth coupling to one of the said telescopic elements fixed to the frame, in order to check the fork against overturning sliding on the frame.

BRIEF DESCRIPTION OF THE DRAWINGS

The structural and functional characteristics of the invention, and its advantages over the know art, will become more apparent from an examination of the following description referred to the appended schematic drawings which show examples of fork units embodies according to the invention. In the drawings.

DETAILED DESCRIPTION OF THE INVENTION

With reference firstly to FIGS. 1 to 4, the fork unit in question consists structurally of a frame 10, generally rectangular, adapted to be applied in a side-shiftable manner to a pair of spaced and transversely extending plate members 11A and B fixed to the front of a lift truck (not shown).

Figure 2:
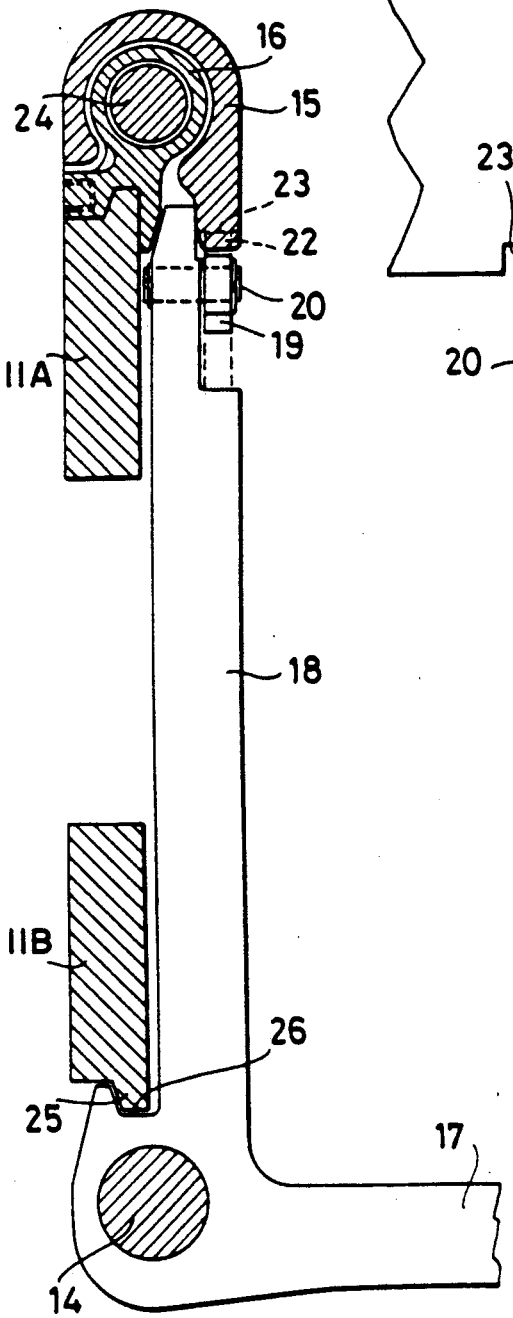
FIG. 2 is an enlarged section taken on the line II—II of FIG. 1.

The frame 10 consists of a pair of vertical side member 12 and a central column 13, which are rigidly interconnected in their lower portions by a support bar 14 and in their upper portions by means of a support bar element 15 which slidingly fits over a shaft element 16 that is fixed to the upper edge of the upper plate member 11A (See FIG. 2).

Figures 1, 3:
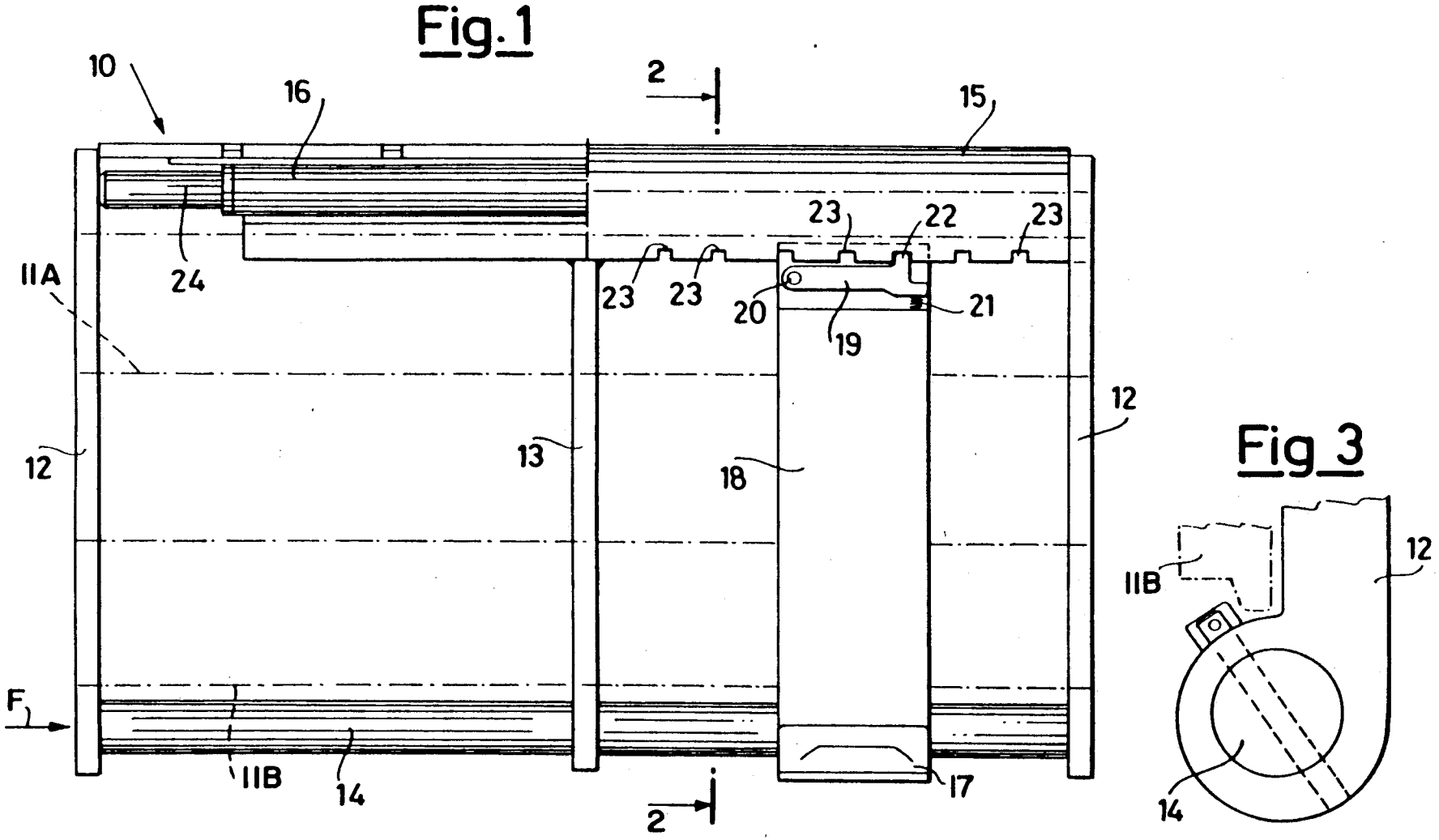
FIG. 1 is a front elevation illustrating a fork unit according to the invention with a portion of the left half broken away.
FIG. 3 is an enlarged partial view taken in the direction of arrow F in FIG. 1.

The frame 10 can carry for example a pair of forks members (only one of which is shown in FIGS. 1 and 2), which each have a horizontally extending tine portion 17 and a vertically extending shank portion 18 which is contained in the same plane as the frame itself. More specifically, the base of the shank 18 is mounted on support bar 14 so that it can slide on the bar, while at its top the shank 18 is engaged with the support bar 15 by means of a disengageable claw-tooth coupling.

Figure 4:
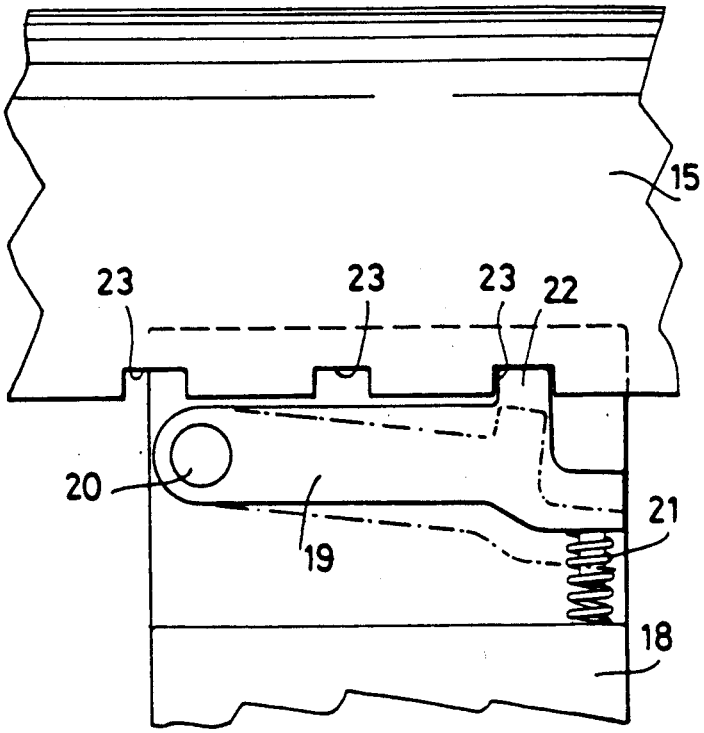
FIG. 4 is an enlarged partial view illustrating the disengageable coupling between the shanks of the forks and the frame.
Figure 6:
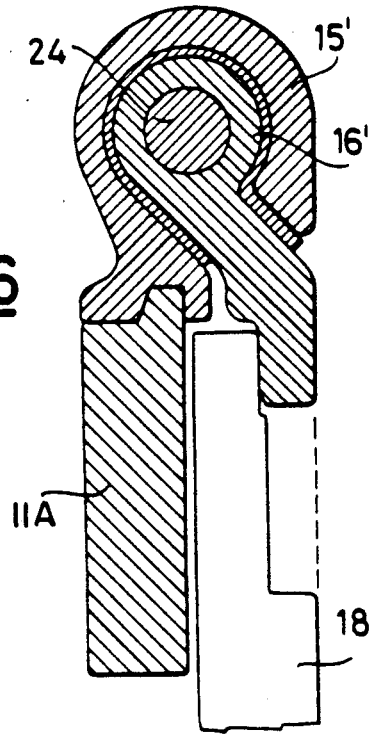
FIG. 6 is an enlarged section taken on the line 6—6 of FIG. 5.

As FIGS. 2 and 4 of the drawings clearly show, the said coupling comprises a lever 19 housed in an undercut at the top of the shank 18 and rotatable about a pivot pin 20 against the action of a return spring 21. The lever 19 has a tooth 22 adapted to engage matching teeth 23 in the support bar 15.

In order for the frame to carry a pair of forks, the bar 15 and its teeth 23 extend over into the left half of FIG. 1 in a manner similar to that shown on the right half.

Each fork can thus be mounted on the frame 10 in a position-wise adjustable manner by sliding on the bar 14.

The side-shift of the frame 10 carrying the fork member with respect to the fixed plate members 11A and B of the lift truck is controlled through the agency of a hydraulic cylinder means. As embodied this means is incorporated in the shaft element 16 in which the shaft comprises the cylinder and from its opposite ends there extend respective stems 24 which act on the sides 12 of the frame.

As can be clearly seen in FIG. 2 of the drawings the frame 10 is coupled to the lower plate member 11B by means of a channel 26 in the lower portions the shanks 18, and thus the frame 10, that engages behind a ledge or projection 25 on the plate 11B.

The parts with relative sliding surfaces can of course be provided with roller or ball bearings to diminish friction, and this may permit the use of a small-diameter hydraulic cylinder external to the side-shifting members.

Figure 5:
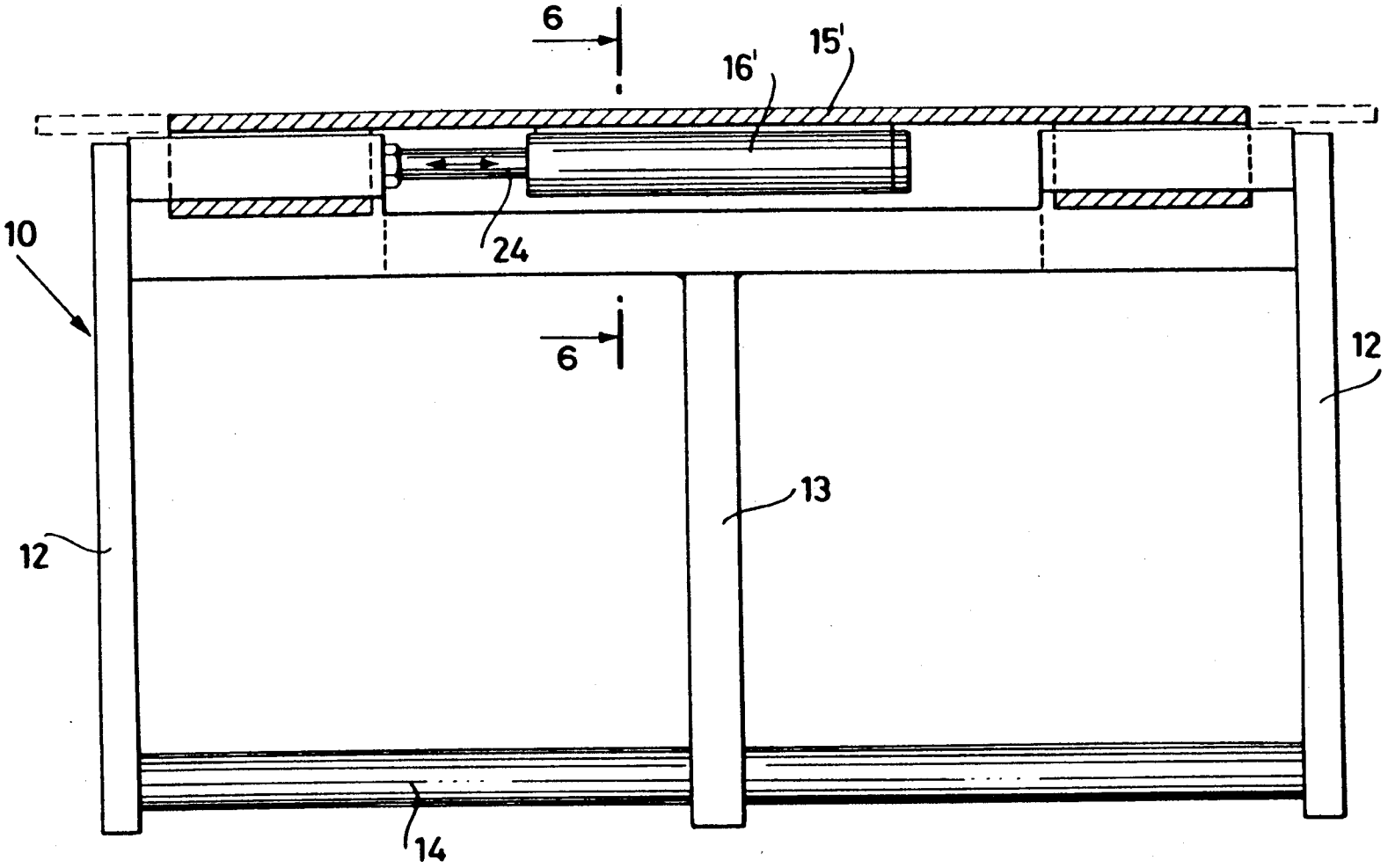
FIG. 5 is a view as in FIG. 1, but illustrating a further embodiment of the invention.

In the embodiment shown in FIGS. 5 and the support bar 15' is fixed to the plate member 11A instead of to the frame 10, while the shaft element 16' is fixed to the said frame.

In such embodiment, parts identical with or equivalent to those of FIGS. 1 to 4 are indicated by the same reference numerals.

It is evident from the foregoing description that the invention has wholly relinquished the traditional fork side-shift device concept in favor of a fork unit totally without the fork-bearing plate member, which in accordance with the invention has been replaced by a frame that contains the shanks of the forks.

In addition, the space occupied by the fixed plate member of the lift truck and by the frame also contains the operating cylinder, which can optionally be positioned in a manner different from that shown, for example at half-height of the lift truck plate member, or below it.

The overall consequence is a structure of extremely limited thickness not exceeding that of traditional lift truck forks, thus leaving lift capacity unaltered and with the same safety margins.

I claim:

1. A side shift fork unit for a fork lift truck comprising a pair of spaced upper and lower horizontally extending plate members fixed to the front of the truck, said upper plate member having a horizontally extending shaft fixed to its upper edge and said lower plate member having a horizontally extending projection on its lower edge, a pair of vertically spaced and transversely extending upper and lower support bars rigidly interconnected by a pair of spaced vertical side members to form a rectangular hollow frame structure, said upper support bar being slidably mounted over said shaft and substantially directly above said upper plate member and said lower support bar being located substantially directly below said lower plate member so that the frame can shift laterally relative to the fixed plate members and the fork lift truck, and a plurality of fork members each having a vertically extending shank portion and a horizontally extending tine portion, the lower ends of said shank portions being slidably mounted for lateral adjustment along said lower support bar of the frame while the upper ends of the shank portions are located behind and restrained from movement in a direction perpendicular to said support bars by a projection on said upper support bar of the frame so that the shank portions of the fork members are located within and substantially in the same plane as the frame structure and immediately in front of the plate members, and the fork members can slide laterally with respect to said frame, coupling means on said fork members that engage with the lower plate member behind the projection on the lower edge of said lower plate member that permits the fork members to slide transversely with respect to said lower plate member while restraining movement of the fork members in a direction perpendicular thereto and said shaft comprising the cylinder of a hydraulic cylinder and having stems extending from opposite ends thereof that act against the vertical side members of the frame to shift the frame relative to the plate members and the truck.

2. The unit of claim 1, wherein the coupling means comprises a transversely extending channel on the lower ends of shank portions of the fork members.

3. The unit of claim 1, including a plurality of spaced apertures in the projection on the upper support bar and a lever having a matching tooth pivotally mounted on the upper end of the shank portions of each fork members for selective engagement with the apertures to permit transverse adjustment of said fork members relative to said frame.

* * * * *